US012296936B2

(12) United States Patent
St. John et al.

(10) Patent No.: US 12,296,936 B2
(45) Date of Patent: May 13, 2025

(54) BOAT SIDE CONSOLE

(71) Applicant: H.I. Boat Works, Steamboat Springs, CO (US)

(72) Inventors: John St. John, Steamboat Springs, CO (US); C. Ray Coleman, Sandy, UT (US)

(73) Assignee: H.I. Boat Works, Steamboat Springs, CO (US)

( * ) Notice: Subject to any disclaimer, the term of this patent is extended or adjusted under 35 U.S.C. 154(b) by 558 days.

(21) Appl. No.: 17/709,051

(22) Filed: Mar. 30, 2022

(65) Prior Publication Data

US 2022/0315192 A1 Oct. 6, 2022

Related U.S. Application Data

(60) Provisional application No. 63/275,219, filed on Nov. 3, 2021, provisional application No. 63/167,986, filed on Mar. 30, 2021.

(51) Int. Cl.

| | |
|---|---|
| ***B63H 25/02*** | (2006.01) |
| ***B63B 15/00*** | (2006.01) |
| ***B63H 21/21*** | (2006.01) |

(52) U.S. Cl.

CPC ..... *B63H 25/02* (2013.01); *B63B 15/00* (2013.01); *B63H 21/21* (2013.01); *B63H 2021/216* (2013.01); *B63H 2025/022* (2013.01); *B63H 2025/028* (2013.01)

(58) Field of Classification Search

CPC .. B63H 25/02; B63H 21/21; B63H 2021/216; B63H 2025/022; B63H 2025/028; B63B 15/00

See application file for complete search history.

(56) References Cited

U.S. PATENT DOCUMENTS

| | | | | |
|---|---|---|---|---|
| 5,507,113 | A * | 4/1996 | Keller | A01K 97/05 206/315.11 |
| 6,189,478 | B1 * | 2/2001 | Myers | B63C 13/00 114/344 |
| 2005/0045087 | A1 * | 3/2005 | Zarn | B63H 21/213 114/364 |
| 2007/0238371 | A1 * | 10/2007 | Nyren | B63H 25/02 440/62 |
| 2008/0314307 | A1 * | 12/2008 | Bramson | B63C 13/00 114/344 |

* cited by examiner

*Primary Examiner* — Stephen P Avila
(74) *Attorney, Agent, or Firm* — Workman Nydegger

(57) ABSTRACT

A modular steering console. The modular steering console has a main console portion having a top side and a side. The top side includes holes for receiving bolts. The side of the main console portion has holes for receiving bolts. The modular steering console has one or more brackets having slots in a top side configured to be fastened to the main console top side by bolts through the slots to allow lateral adjustment of the brackets while allowing a side of the brackets and the side of the main console portion to sandwich a side of a boat.

20 Claims, 10 Drawing Sheets

BOAT SIDE CONSOLE

CROSS-REFERENCE TO RELATED APPLICATIONS

This application claims the benefit of and priority to U.S. Provisional Patent Application Ser. No. 63/167,986 filed on Mar. 30, 2021 and entitled "Boat Side Console," and also U.S. Provisional Patent Application Ser. No. 63/275,219 filed on Nov. 3, 2021 and entitled "Boat Side Console," which applications are expressly incorporated herein by reference in their entirety.

BACKGROUND

Background and Relevant Art

Small watercraft are often simple in their design. That is, these watercraft are manufactured in a minimalistic fashion such that they include only very basic components. For example, the basic watercraft may include seats and potentially a mount at the stern of the watercraft for mounting a motor. It is assumed that navigation of the watercraft will occur by the user directly interacting with the motor at the stern of the watercraft.

However, boaters may wish to add additional elements to their watercraft. In particular, a boater may wish to change how navigation of the craft occurs. For example, some boaters may prefer to have a console mounted more towards the bow or midsection of the watercraft having steering and throttle controls so as to be able to navigate the craft from that location. Currently, there exist modular console units that can be added to basic watercraft for adding steering and throttle controls. However, these modular consoles are large and obtrusive and obstruct large portions of the floor of the watercraft. Thus, it would be useful to implement a modular console unit that is less obtrusive than previous modular consoles.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

A modular steering console. The modular steering console has a main console portion having a top side and a side. The top side includes holes for receiving bolts. The side of the main console portion has holes for receiving bolts. The modular steering console has one or more brackets having slots in a top side configured to be fastened to the main console top side by bolts through the slots to allow lateral adjustment of the brackets while allowing a side of the brackets and the side of the main console portion to sandwich a side of a boat.

In another embodiment of a modular steering console, the modular steering console has a main console portion having a top side and a side. The top side includes slots for receiving bolts. The side of the main console portion has holes for receiving bolts. The modular steering console has one or more brackets having a top side configured to be fastened to the main console top side by bolts through the slots to allow lateral adjustment of the brackets while allowing a side of the brackets and the side of the main console portion to sandwich a side of a boat.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

and

Figure 10:
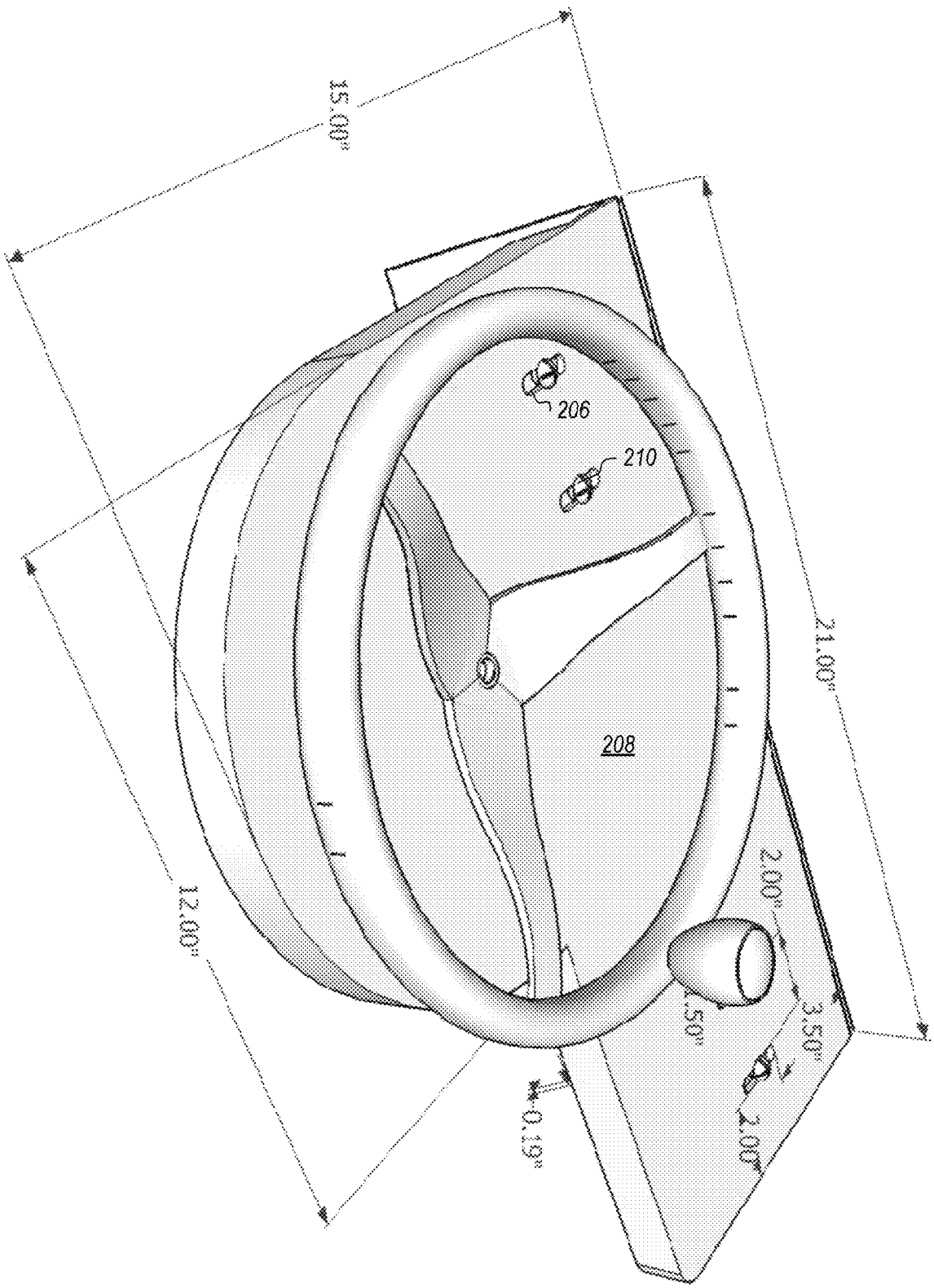

FIG. 10 illustrates a perspective view from a top side and side of a modular console unit.

DETAILED DESCRIPTION

Embodiments illustrated herein are directed to an adjustable marine steering console that utilizes a sliding-adjustable bracket that is secured by thru-bolting the adjustable bracket on the underside of the console to the outside part of the console that is bent over the gunwale of the boat.

The bracket is adjustable along the top side of the console with cut slots in the bracket for bolts. These bolts lock the adjustable bracket arm in place topside once the bracket is slid into place firmly against the inside wall of the boat, and thru-bolted. The console is made solid by thru-bolting the underside bracket to the console's outside wall, and the top side bolts thru-bolted to the underside arms of the bracket.

Alternatively, the bracket is adjustable along the top side of the console with cut slots for bolts. These bolts lock the adjustable bracket arm in place topside once the bracket is slid into place firmly against the inside wall of the boat, and thru-bolted. The console is made solid by thru-bolting the underside bracket to console's outside wall, and the top side bolts thru-bolted to the underside arms of the bracket.

Examples are now illustrated by reference to the figures.

In particular, FIGS. 1-6 illustrate a modular console 100 that can be added to a boat 101 to provide a steering console to the boat 101. The console 100 includes a main console portion 102 and a plurality of adjustable brackets 104. The brackets have a plurality of slots 106 formed in top portions of the brackets. Bolts 110 can be passed through the slots 106 and through the holes formed in the top side of the main console portion 102 of the console 100. This allows the brackets 104 to be laterally adjusted to accommodate different hull thicknesses on boats. Note that the brackets 104 further include an angled portion 114 that is neither coplanar with the top side 108 of the main console portion 102 nor side 116 of the main console portion 102 which allows the modular console 100 to fit around the gunwale of a boat. Note that the top side 108 and side 116 form an angle. Similarly, the top sides 103 and the sides 116 of the brackets 104, in some embodiments, form the same angle to cause a tight fit to the wall of the boat.

Figure 4:
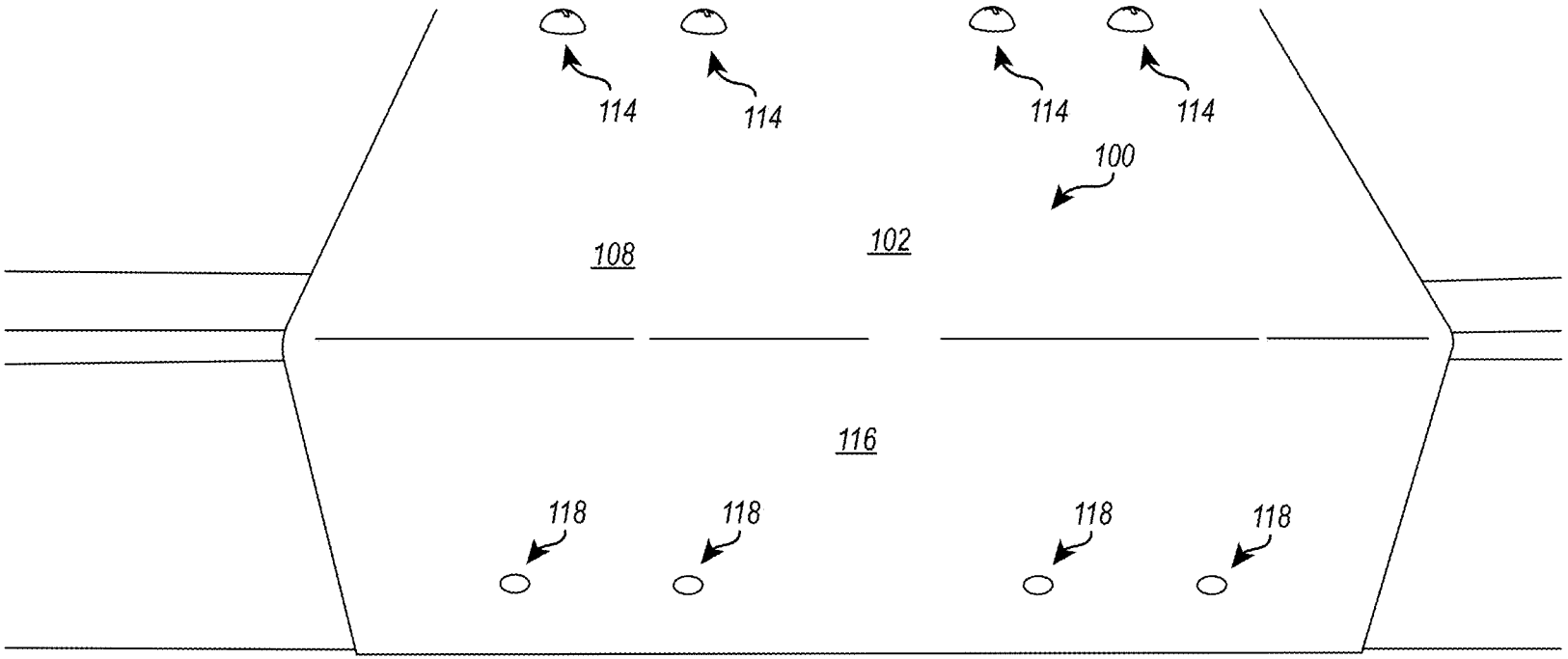
FIG. 4 illustrates a partial rear perspective view of a modular console unit.
Figure 5:
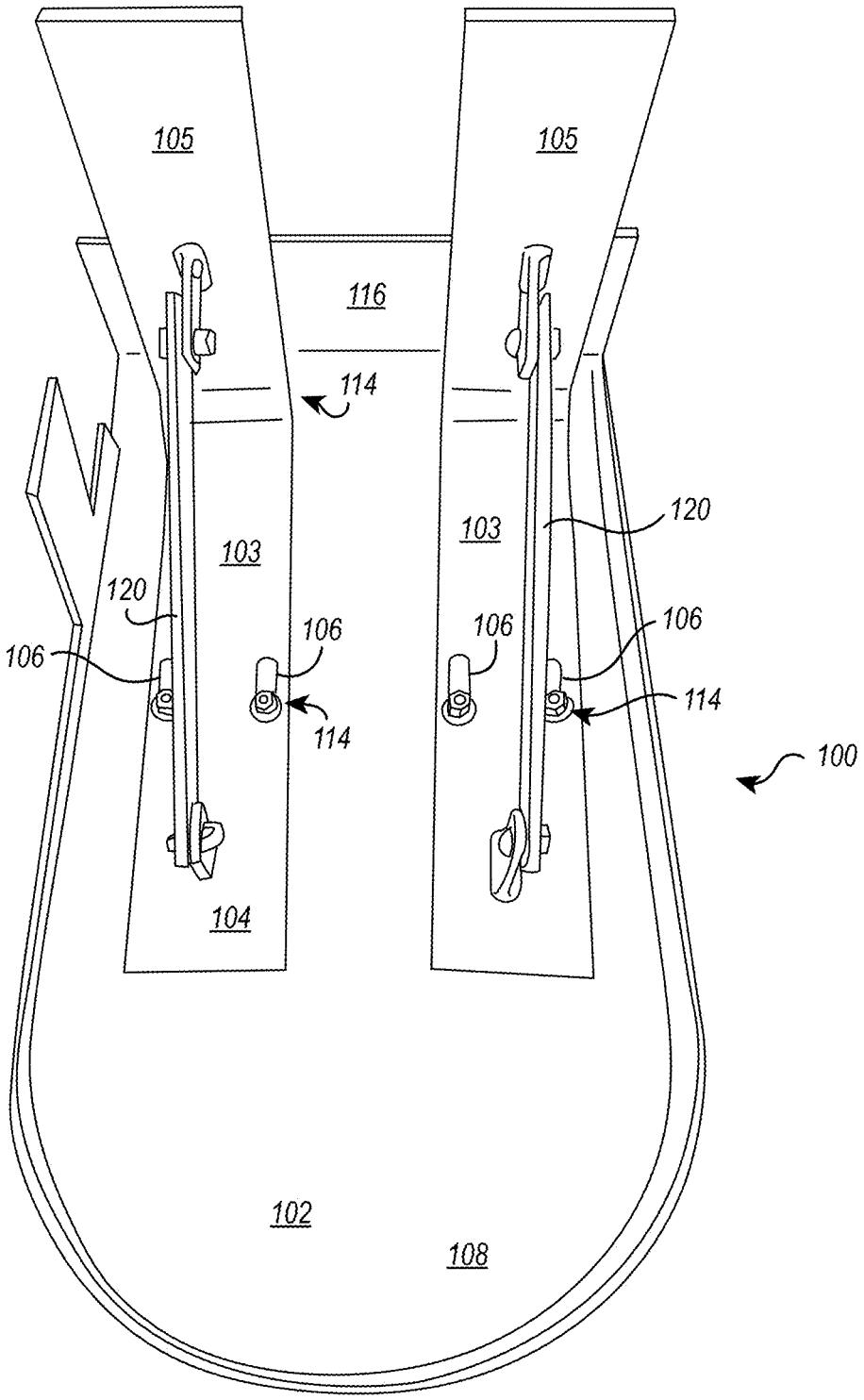
FIG. 5 illustrates a perspective view from of a bottom side of a modular console unit.
Figure 6:
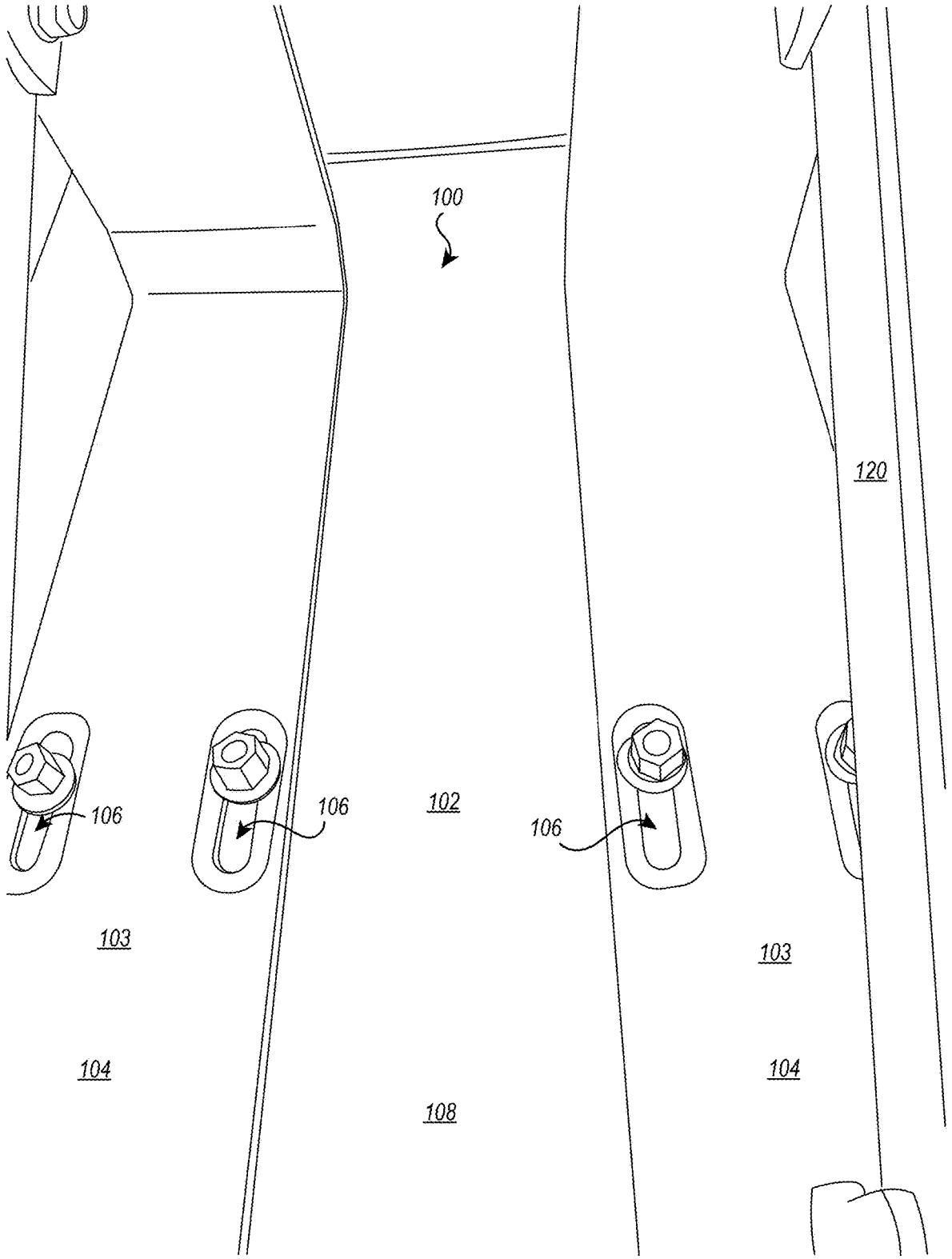
FIG. 6 illustrates a perspective view from of a portion of the bottom side of a modular console unit to show slot and bolt detail.

Referring now to FIG. 4 holes 118 through the side 116 of the of the main console portion 102 are shown. Note that in some embodiments no corresponding holes are pre-formed in sides 105 of the brackets 104. Rather, in some embodiments, once the modular console 100 has been fitted to a particular boat with the hull of the boat between the bracket side 105 and the main console portion side 116, the brackets 104 can be marked for further drilling to ensure that the holes 118 line up with any holes formed in the brackets 104. This can be accomplished using writing implements such as markers or other implements. Alternatively or additionally, an installer can use a drill bit to begin partially drilling through the brackets 104. The brackets 104 can then be drilled through either by removing the brackets and finishing drilling or by finishing the drilling process with the brackets 104 remaining in place.

Once appropriate holes have been drilled in the brackets 104 (and the side of the boat) the brackets can be secured to the main console portion 102 by passing a bolt through the side 116 of the main console portion 102, through holes drilled in the hull of the boat, and finally through the holes formed in the brackets 104, where the bolt can be secured using appropriate fasteners hardware such as appropriate nuts and washers. This allows the sides 105 and 116 to sandwich the side of the boat. The fit of the brackets 104 to the main console portion 102 is further facilitated by having the top side 103 and sides 105 be at the angle for the top side 108 and side 116 of the main console portion 102. Note further that appropriate epoxies and other compounds can be used to seal the side of the boat to prevent leakage.

Note that the figures further illustrate stabilizers 120 attached to the bracket side 105 and bracket top side 103. These stabilizers 120 may be attached using linkages as shown to allow for adjustability in installation.

Figure 1:
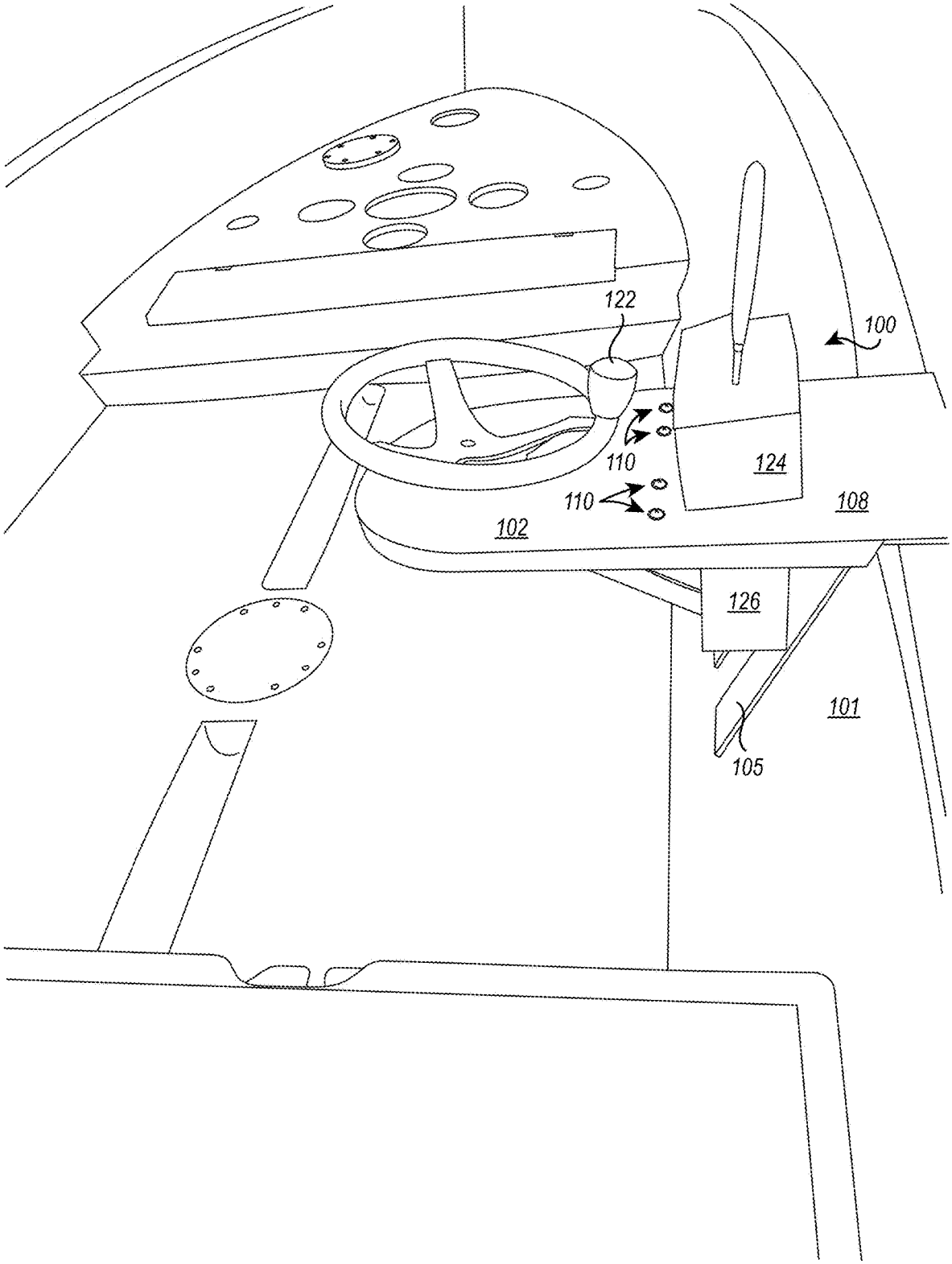
FIG. 1 illustrates a perspective top view a modular console unit.
Figure 2:
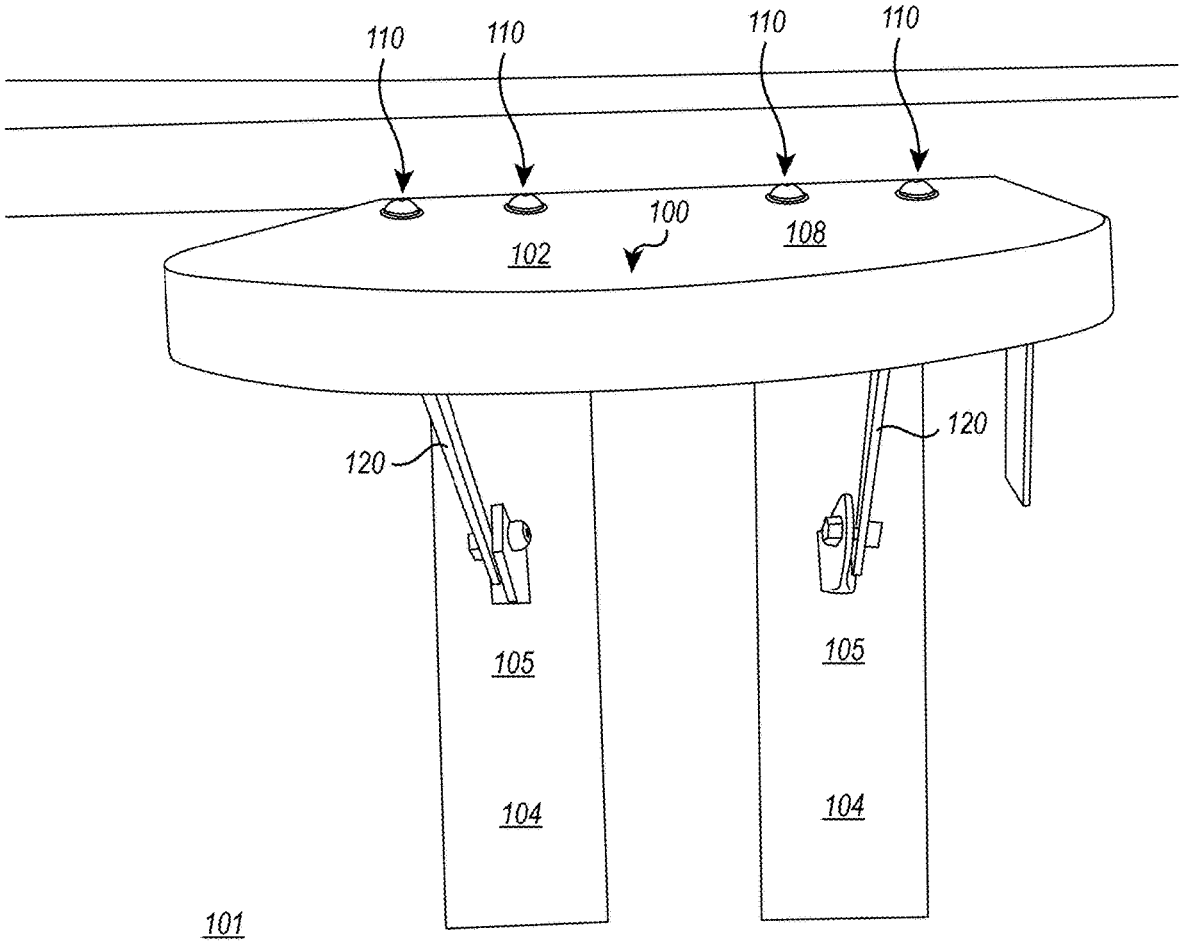
FIG. 2 illustrates a front view of a modular console unit.

Referring once again to FIG. 1, the console may further have attached to it a steering wheel 122 and a throttle/shifter box 124 for controlling steering and speed. FIG. 1 further illustrates an accessory plate 126 that may be included on the side of the console. The accessory plate 126 may be used for mounting switches or other accessories.

With regard to the materials used for the various embodiments, various different materials may be used. For example, in some embodiments the main console portion 102 and the brackets 104 are formed from aluminum. In some embodiments, the brackets 104 have a thickness of 3/16 while the main console portion 102 has a thickness of 1/8. Note that other thicknesses may be used as appropriate.

Note that other materials may be used including stainless steel, painted steel, or even cured materials such as fiberglass or other appropriate materials. Note that in some embodiments, materials are selected to be comparatively lightweight so as to prevent excessive rotational stress forces on the hull of the boat.

Figure 3:
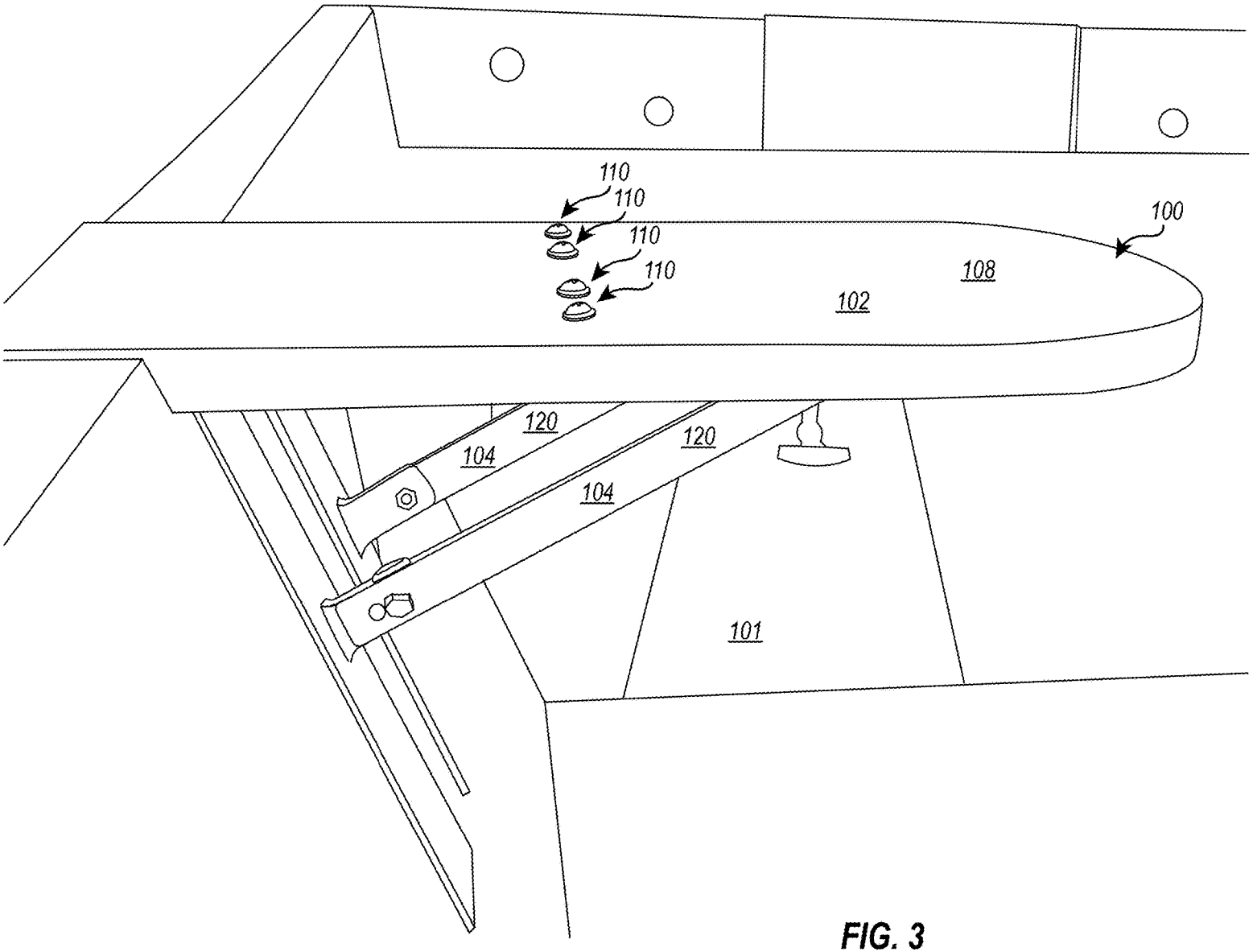
FIG. 3 illustrates a side view of a modular console unit.

FIGS. 7-10 illustrate a modular console 200 that can be added to a boat to provide a steering console to the boat. The console 200 includes a main console portion 202 and a plurality of adjustable brackets 204. As illustrated in FIGS. 3 and 4, the main console portion 202 has a plurality of slots 206 formed in a top side 208 of the main console portion 202. Bolts 210 can be passed through the slots 206 and through the holes 212 formed in top sides 203 of the brackets 204. This allows the brackets to be laterally adjusted to accommodate different hull thicknesses on boats. Note that the brackets 204 further include an angled portion 214 that is neither coplanar with the topside 208 of the main console portion 202 nor side 216 of the main console portion 202 which allows the modular console 200 to fit around the gunwale of a boat. Note that the top side 208 and side 216 form an angle. Similarly, the top sides 203 and the sides 204 of the brackets 204 form the same angle to cause a tight fit to the wall of the boat.

Figure 7:
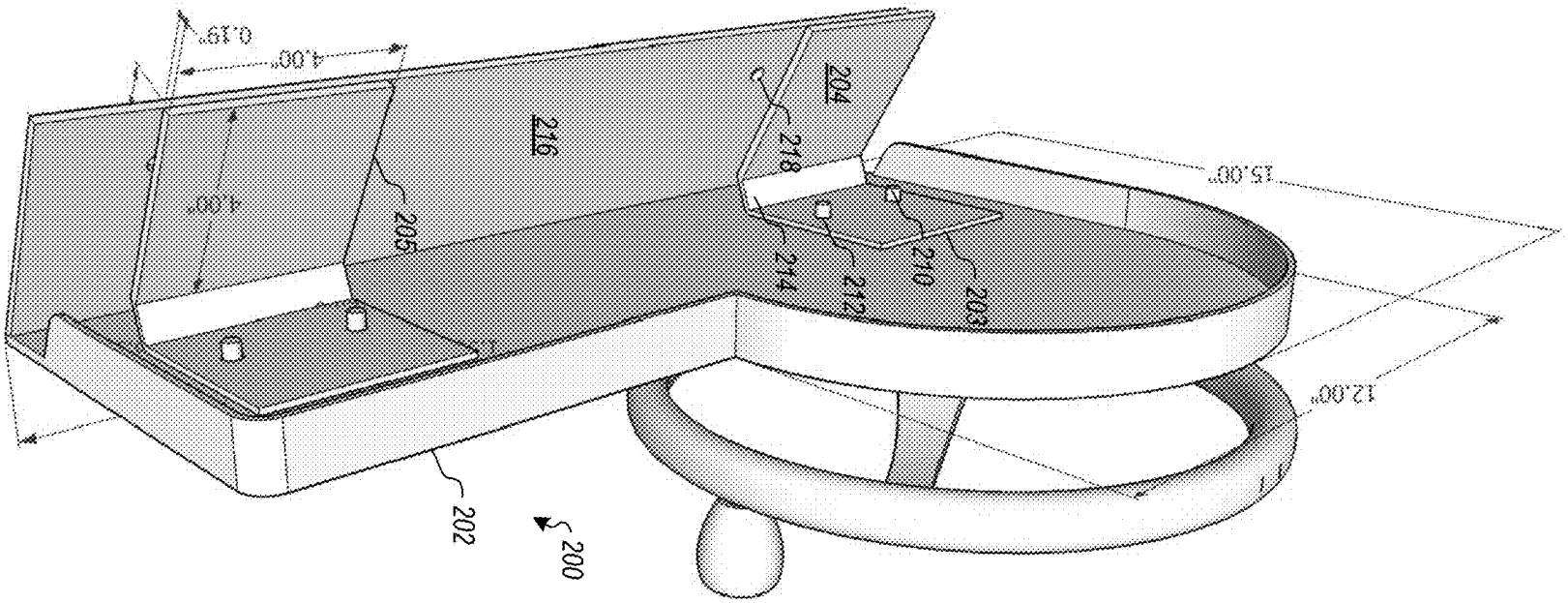
FIG. 7 illustrates a perspective view from a bottom side of a modular console unit.
Figure 8:
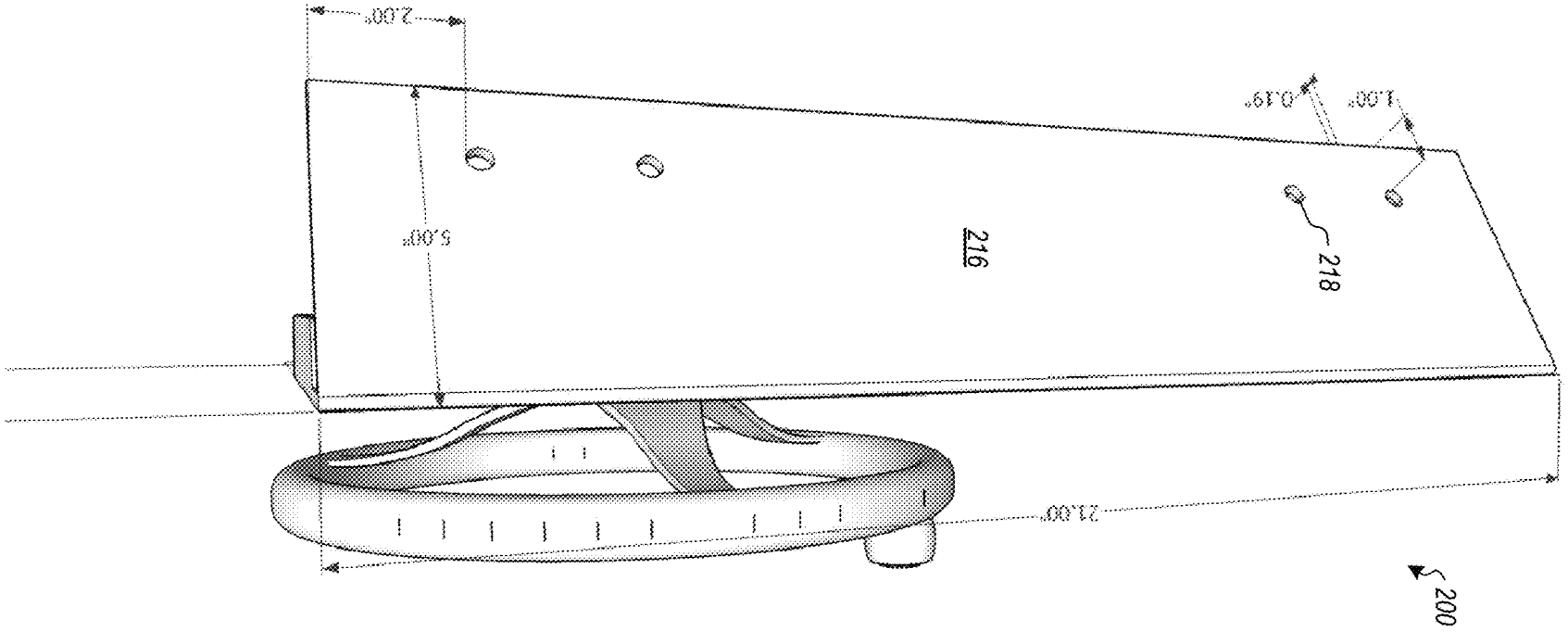
FIG. 8 illustrates a side view of a modular console unit.
Figure 9:
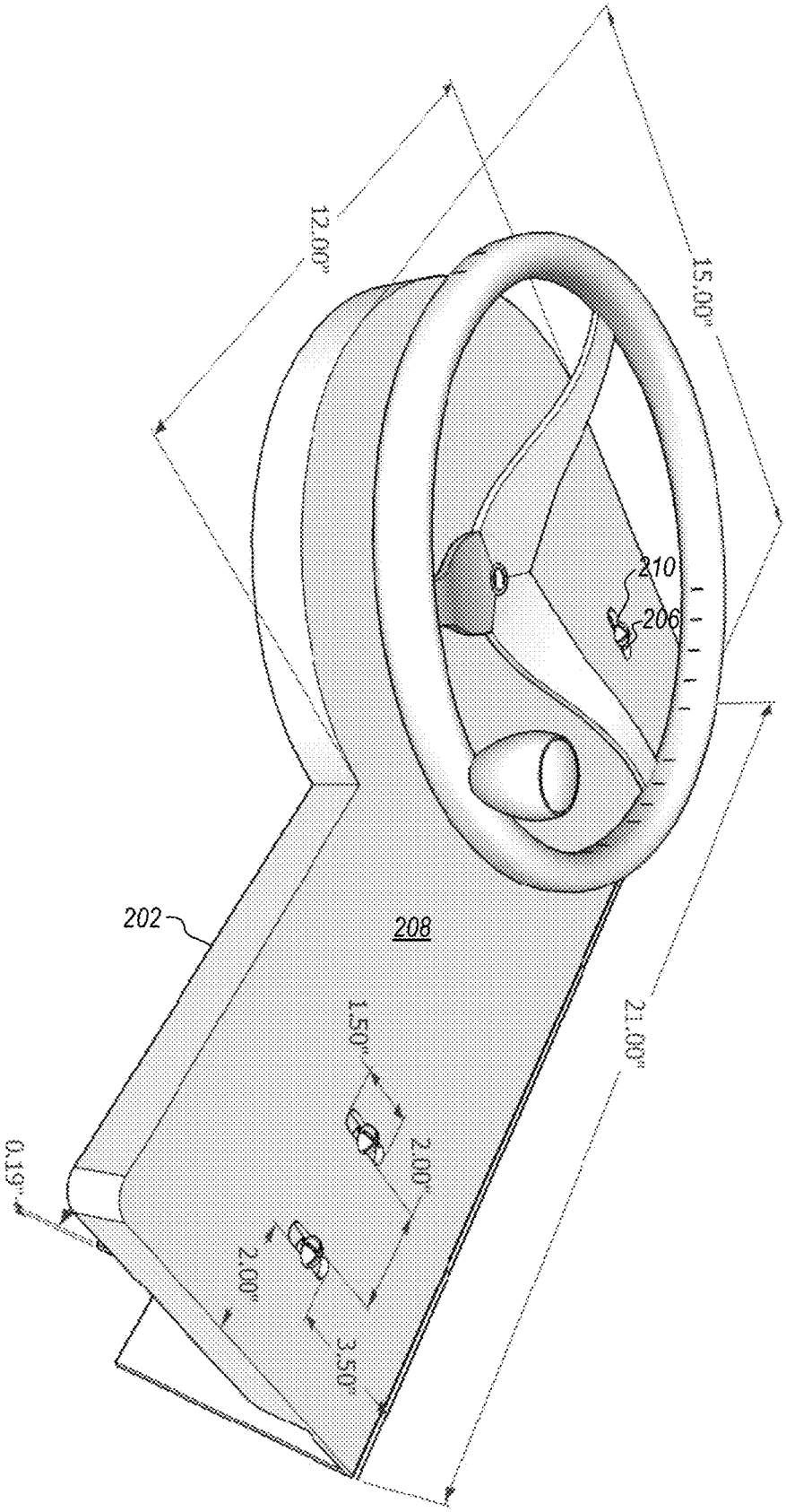
FIG. 9 illustrates a perspective view from a top side of a modular console unit.

Referring now to FIGS. 7 and 8 FIG. 8 illustrates bolt holes 218 through the side 216 of the of the main console portion 202. Note that FIG. 7 illustrates that in some embodiments no corresponding holes are pre-formed in sides 205 of the brackets 204. Rather, in some embodiments, once the modular console 200 has been fitted to a particular boat with the hull of the boat between the bracket side 205 and the main console portion side 216, the brackets 204 can be marked for further drilling to ensure that the holes 218 line up with any holes formed in the brackets 204. This can be accomplished using writing implements such as markers or other implements. Alternatively or additionally, an installer can use a drill bit to begin partially drilling through the brackets 204. The brackets 204 can then be drilled through either by removing the brackets and finishing drilling or by finishing the drilling process with the brackets 204 remaining in place.

Once appropriate holes have been drilled in the brackets 204 (and the side of the boat) the brackets can be secured to the main console portion 202 by passing a bolt through the side 216 of the main console portion 202, through holes drilled in the hull of the boat, and finally through the holes formed in the brackets 204, where the bolt can be secured using appropriate fasteners hardware such as appropriate nuts and washers. This allows the sides 205 and 216 to sandwich the side of the boat. The fit of the brackets 204 to the main console portion 202 is further facilitated by having the top side 203 and sides 205 be at the angle for the top portion 208 and side 216 of the main console portion 202. Note further that appropriate epoxies and other compounds can be used to seal the side of the boat to prevent leakage.

With regard to the materials used for the various embodiments, various different materials may be used. For example, in some embodiments the main console portion 202 and the brackets 204 are formed from aluminum. In some embodiments, the brackets 204 have a thickness of 3/16 while the main console portion 202 has a thickness of 1/8. Note that other thicknesses may be used as appropriate.

Note that other materials may be used including stainless steel, painted steel, or even cured materials such as fiberglass or other appropriate materials. Note that in some embodiments, materials are selected to be comparatively lightweight so as to prevent excessive rotational stress forces on the hull of the boat.

The present invention may be embodied in other specific forms without departing from its characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular steering console comprising:

a main console portion having a top side and a side extending at an angle from the top side, wherein the top side comprises at least one main console hole or at least one main console slot for receiving bolts;

one or more brackets having one or more top sides comprising at least one bracket slot if the main console portion top side comprises the at least one main console hole or at least one bracket hole if the main console portion top side comprises the at least one main console slot configured to be fastened to the main console top side by at least one bolt through the at least one bracket slot or the at least one bracket hole to allow lateral adjustment of the brackets while allowing a side of the brackets and the side of the main console portion to sandwich a side of a boat; and wherein the one or more brackets comprise an angled portion between the one or more top sides of the one or more brackets and the side of the brackets that is neither coplanar with the top side of the main console portion nor the side of the main console portion in a fashion that allows the modular console to fit around a gunwale of a boat.

2. The modular steering console of claim 1, wherein the top sides of the brackets and the sides of the brackets are formed at the angle for the main console portion.

3. The modular steering console of claim 1, wherein the side extending at an angle from the top side of the main console portion comprises one or more side holes configured to receive bolts through the side holes.

4. The modular steering console of claim 3, wherein portions of the brackets corresponding to the one or more side holes do not include holes, allowing hull holes to be later drilled through a hull of the boat and side bracket holes through the corresponding portions of the brackets corresponding to the side holes, allowing corresponding holes to be drilled at install time.

5. The modular steering console of claim 1, further comprising stabilizers attached to a bracket side and a bracket top side using linkages.

6. The modular steering console of claim 1, further comprising an accessory plate configured to have switches or other accessories mounted to it.

7. The modular steering console of claim 1, further comprising a steering wheel.

8. The modular steering console of claim 1, further comprising a throttle/shifter box.

9. A method of manufacturing a modular steering console the method comprising:

forming a main console portion to have a top side and a side extending at an angle from the top side, including forming at least one main console hole or at least one main console slot in the top side for receiving bolts;

forming one or more brackets having one or more top sides including forming at least one bracket slot if the main console portion top side comprises the at least one main console hole or at least one bracket hole if the main console portion top side comprises the at least one main console slot configured to be fastened to the main console top side by bolts through the at least one bracket slot or the at least one bracket hole to allow lateral adjustment of the brackets while allowing sides of the brackets and the side of the main console portion to sandwich a side of a boat; and forming one or more side holes configured to receive bolts through the one or more side holes in the side extending at an angle from the top side of the main console portion.

10. The method of claim 9, further comprising forming the top sides of the brackets and the sides of the brackets at the angle for the main console portion.

11. The method of claim 9, further comprising forming an angled portion between the one or more top sides of the one or more brackets and the sides of the brackets that is that is neither coplanar with the top side of the main console portion nor side of the main console portion in a fashion that allows the modular console to fit around a gunwale of a boat.

12. The modular steering console of claim 9, further comprising forming portions of the brackets corresponding to the side holes without holes, allowing hull holes to be later drilled through a hull of the boat and side bracket holes through the corresponding portions of the brackets corresponding to the side holes, allowing corresponding holes to be drilled at install time.

13. The modular steering console of claim 9, further comprising covering the bolts received through the side holes with epoxy.

14. The method of claim 9, further comprising attaching stabilizers to a bracket side and a bracket top side using linkages.

15. The method of claim 9, further comprising attaching an accessory plate to the main console portion, the accessory plate configured to have switches or other accessories mounted to it.

16. The method of claim 9, further comprising attaching a steering wheel to the main console portion.

17. The method of claim 9, further comprising attaching a throttle/shifter box to the main console portion.

18. A modular steering console comprising:

a main console portion having a top side and a side extending at an angle from the top side, wherein the top side comprises at least one main console hole or at least one main console slot for receiving bolts; and one or more brackets having one or more top sides comprising at least one bracket slot if the main console portion top side comprises the at least one main console hole or at least one bracket hole if the main console portion top side comprises the at least one main console slot configured to be fastened to the main console top side by at least one bolt through the at least one bracket slot or the at least one bracket hole to allow lateral adjustment of the brackets while allowing a side of the brackets and the side of the main console portion to sandwich a side of a boat; and stabilizers attached to a bracket side and a bracket top side using linkages.

19. The modular steering console of claim 18, wherein the one or more brackets comprise an angled portion between the one or more top sides of the one or more brackets and a side of the brackets that is neither coplanar with the top side of the main console portion nor the side of the main console portion in a fashion that allows the modular console to fit around a gunwale of a boat.

20. The modular steering console of claim 18, further comprising one or more side holes configured to receive bolts through the one or more side holes in the side extending at an angle from the top side of the main console portion.

* * * * *